US007007706B2

(12) United States Patent
Pinnell et al.

(10) Patent No.: US 7,007,706 B2
(45) Date of Patent: Mar. 7, 2006

(54) SHELTER STRUCTURE

(75) Inventors: Graham Allan Pinnell, Kenmore Hills (AU); Daniel Robert Flynn, Indooroopilly (AU); Alan Ned Netherway, Canungra (AU)

(73) Assignee: Weatherstopper Pty Ltd., (AU)

( * ) Notice: Subject to any disclaimer, the term of this patent is extended or adjusted under 35 U.S.C. 154(b) by 144 days.

(21) Appl. No.: 10/311,699

(22) PCT Filed: Jun. 26, 2001

(86) PCT No.: PCT/AU01/00755

§ 371 (c)(1),
(2), (4) Date: Jun. 26, 2003

(87) PCT Pub. No.: WO02/01012

PCT Pub. Date: Jan. 5, 2002

(65) Prior Publication Data

US 2004/0035455 A1 Feb. 26, 2004

(51) Int. Cl.

| | |
|---|---|
| ***E04B 1/34*** | (2006.01) |
| ***E04B 1/342*** | (2006.01) |
| ***E04B 7/14*** | (2006.01) |
| ***E04H 15/34*** | (2006.01) |
| ***E04H 15/44*** | (2006.01) |

(52) U.S. Cl. ..... 135/88.01; 135/123; 135/906; 135/912

(58) Field of Classification Search ..... 135/88.01, 135/912, 906, 123, 124; 52/223.14, 143

See application file for complete search history.

(56) References Cited

U.S. PATENT DOCUMENTS

| | | | | | |
|---|---|---|---|---|---|
| 1,840,745 | A | * | 1/1932 | Shoaf | 135/98 |
| 1,985,599 | A | * | 12/1934 | Cates et al. | 52/643 |
| 2,000,205 | A | * | 5/1935 | Wickstrum | 135/98 |
| 2,239,817 | A | * | 4/1941 | Gross | 52/86 |
| 2,575,572 | A | * | 11/1951 | Wickstrum | 135/157 |
| 2,677,384 | A | * | 5/1954 | August | 135/123 |
| 3,030,973 | A | * | 4/1962 | Janda et al. | 135/129 |

(Continued)

FOREIGN PATENT DOCUMENTS

DE 23 56 928 5/1975

(Continued)

OTHER PUBLICATIONS

International Search Report.

*Primary Examiner*—Robert Canfield
(74) *Attorney, Agent, or Firm*—Cantor Colburn LLP

(57) ABSTRACT

A shelter structure having a pair of end frames and a canopy frame interconnecting the end frames. There are also provided a plurality of adjustable bracing members interconnecting frame members of the canopy frame. The adjustable bracing members may be tensioned during installation of the shelter structure to stabilize the canopy frame against lateral or transverse forces.

22 Claims, 6 Drawing Sheets

U.S. PATENT DOCUMENTS

| | | | | | |
|---|---|---|---|---|---|
| 3,085,586 | A | | 4/1963 | McDonough | |
| 3,356,381 | A | * | 12/1967 | Rayfield | 280/30 |
| 3,534,511 | A | * | 10/1970 | Cappella | 52/63 |
| 3,798,851 | A | * | 3/1974 | Utahara | 52/86 |
| 4,173,857 | A | | 11/1979 | Kosaka | |
| 5,564,234 | A | * | 10/1996 | Vermeulen | 52/63 |
| 5,575,301 | A | | 11/1996 | Bolton | |
| 5,595,203 | A | * | 1/1997 | Espinosa | 135/124 |
| 5,967,162 | A | | 10/1999 | Bolton | |
| 6,112,756 | A | | 9/2000 | Tseng | |
| 6,367,496 | B1 | * | 4/2002 | Rempel et al. | 135/122 |
| 6,418,953 | B1 | * | 7/2002 | Novotny | 135/156 |

FOREIGN PATENT DOCUMENTS

| | | |
|---|---|---|
| GB | 1 484 236 | 9/1977 |
| WO | 91/19872 | 12/1991 |
| WO | 95/27114 | 10/1995 |

* cited by examiner

SHELTER STRUCTURE

FIELD OF THE INVENTION

THIS INVENTION relates to a shelter structure which is preferably movable although this is not essential. The shelter structure can be used for a variety of outdoor activities including covered walkways, car yards, shopping centres, and sporting activities including archery, rifle shooting, bowling, tennis, golf or portable grandstands as may be required.

BACKGROUND OF THE INVENTION

A conventional golf practice shelter is currently marketed under the trade mark WEATHERSTOPPER and includes a pair of end frames supported by ground engaging wheels and a canopy or roof frame to which a roofing sheet or canopy was attached. Each end frame included a horizontal wheel support rail which was also oriented transversely to the canopy frame to which an associated wheels were attached. Each end frame also incorporated a central upright which was attached to the wheel support rail. Each end frame also included an upper rail parallel to the horizontal wheel support rail and oblique bracing members interconnecting each end of the upper rail and a top end of the central upright. The canopy frame comprised a pair of lower longitudinal horizontal rails, a top horizontal longitudinal rail and a plurality of hoops located at spaced intervals along the length of the canopy frame. Each of the hoops were attached to a hoop support rail which was located outwardly of an adjacent lower horizontal longitudinal rail and parallel thereto. There was also provided angled bracing members, interconnecting each of the hoop support rails and the adjacent lower horizontal rail. There was also provided transverse bracing members interconnecting mutually opposite locations on each lower horizontal rail as well as diagonal horizontal bracing members interconnecting diagonally opposite locations on each lower horizontal rail. There was further provided oblique bracing members interconnecting each lower horizontal rail and the top horizontal rail.

The aforementioned WEATHERSTOPPER shelter structure was useful in that it enabled golf practice to occur in inclement weather. The shelter structure was also driven by heavy duty motors and there was 90 degree movement on all four wheels. It was also available in three different sizes i.e. having a length of 19 metres, 26 metres and 32.5 metres. Each wheel was attached directly to an associated wheel support rail by a horizontal axle so that each wheel was located laterally and outwardly of the wheel support rail.

It was found however in practice that while the WEATHERSTOPPER golf practice shelter was satisfactory in operation it was relatively complicated in structure in relation to the canopy frame because of the provision of a pair of longitudinal hoop support rails and the angled bracing members.

Another more significant disadvantage of the WEATHERSTOPPER golf practice shelter was that it was top heavy and thus had a tendency to be unstable in strong cross winds or cyclones. This meant that the canopy frame had a tendency to be subject to negative camber (i.e. wherein frame members may sag under strong cross winds) as well as positive camber (i.e. wherein frame members of the roof frame had a tendency to bow upwardly under strong cross winds).

Another disadvantage of the prior art was that each golf practice shelter was built at an installation site and thus was a "one-off" construction wherein the entirety of each of the frame members of the roof frame were fixedly or non adjustably attached to each other. This meant that construction was relatively expensive.

Reference may be made to U.S. Pat. No. 3,085,586, which describes a foldable tent structure having a pair of generally U-shaped end frames, which were relatively movably, interconnected by one or more tie elements which are maintained under tension as each of the end frames are moved from a collapsed to an erect position.

Reference also may be made to International Publication No WO 91/19872, which describes a method of erection of a tent having frame sections interconnected by longitudinal beams. Each frame section is located in spaced apart positions and hingedly attached to the longitudinal beams and elevated from an oblique position to a vertical position when erected.

U.S. Pat. No. 6,112,756 refers to a canopy support frame attached to a plurality of legs extending upwardly from the ground. The canopy support frame includes a plurality of support rods, which are each orientated in an oblique orientation on each side of the canopy frame, which each interconnect a top horizontal bar at the top of the canopy frame and a lower horizontal bar attached to a respective set of legs. Each of the support rods are interconnected on each side of the canopy frame by a tensionable wire to tension the overall frame structure when erected.

U.S. Pat. No. 4,173,857 refers to a double layered wooden arch truss for roof frameworks. There are provided stretchable chord members between each end of the arch truss to provide the arch members with greater strength. There also may be provided adjustable length turnbuckles constituting angle ties which interconnect a lower truss member and an adjacent upright.

International Publication No WO 95/27114 refers to a collapsible covered structure including a plurality of spaced arches and an awning dimensioned to be received within a space defined by opposed parts of each arch and wherein means are provided to suspend the awning to each arch.

DE 2356928 refers to a canopy frame having a pair of parallel U-sahaped horizontal rails and a plurality of flexible U-shaped hoops which have a plurality of spaced pulleys attached thereto interconnected by tensionable wires anchored to each U-shaped horizontal rail.

Reference is made to GB 1484236, which refers to a roof structure comprising a plurality of truss members interconnected by purlins. Each truss member has a top compression tube and a bottom tension tube connected together by vertical struts. The bottom tension tube has within it at least one high tension steel cable, which is tensioned during erection before being anchored at each end of the bottom tension tube.

The abovementioned prior art in the form of the WEATHERSTOPPER support structure had a particular disadvantage as a movable support structure, in that there was no means to effectively dissipate load bearing forces created by flexing of the frame members of the canopy frame during heavy winds. This led to instability in strong cross winds as stated above. The other prior art discussed above related mainly to frame structures which were not designed to be movable from place to place and, thus, could not be used as golf practice shelters.

It is therefore an object of the invention to provide a shelter structure which may alleviate at least one of the disadvantages discussed above.

SUMMARY OF THE INVENTION

The shelter structure of the invention includes a pair of end frames and a canopy frame interconnecting the end frames, characterized in that the canopy frame includes a plurality of adjustable oblique bracing members interconnecting frame members of the canopy frame, whereby said adjustable bracing members may be tensioned during installation of the shelter structure to stabilize the canopy frame when supported by each end frame against lateral or transverse forces; and ground engaging wheel(s) supporting each end frame and located directly below each end frame end driven by drive means, wherein said wheel(s) absorb any loading imparted to said oblique bracing members during heavy winds.

The drive means may be a heavy duty electric motor coupled to one or each wheel for maximum efficiency.

Each end frame may also include one or a plurality of ballast tanks so as to provide each end frame with greater weight. The or each ballast tank may be located in a bottom or base part of each end frame.

Each end frame may also be provided with a base frame to which are attached wheel support members whereby each wheel is located under the base frame so that any loading imparted to each end frame is directly translated to each wheel. Suitably each base frame may also carry the one or more of the ballast tanks described above.

Each end frame may also include a plurality of uprights or more preferably oblique vertical frame members. Most preferably the oblique frame members are arranged in parallel pairs and interconnected by cross members.

The canopy frame preferably comprises a pair of spaced and parallel horizontal lower rails and a top horizontal rail. There also may be provided a plurality of hoop assemblies comprising a hoop or arcuate member, a base rail for the hoop and an upright interconnecting an apex of the hoop and a mid point of the base rail. The hoop assemblies may be supported or attached to each of the lower rails and the top rail in any suitable manner.

There also may be provided horizontal bracing members which may interconnect each of the lower rails and more preferably diagonally opposite connection points of hoop assemblies with each lower rail. These horizontal bracing members may be adjustable if desired but more suitably are non-adjustable or fixed in position.

There also are provided oblique bracing members which, in a preferred embodiment, interconnect diagonally opposite connection points of:

(i) hoop assemblies with each lower rail; and (ii) hoop assemblies and the top horizontal rail.

It is necessary that such oblique bracing members be adjustable in tension and this may be achieved by:

(a) individual adjustment of each oblique bracing member; or (b) adjustment of adjacent oblique bracing members in unison wherein a pair of such bracing members may be attached to a support member and the support member is moveably adjusted relative to a fixed or stationary bracket.

Preferably, both individual adjustment and adjustment of adjacent oblique members is carried out.

In a preferred embodiment of the invention there is provided a connection assembly which interconnects two pairs of oblique bracing members and which facilitates individual adjustment of bracing members as well as adjustment of one pair of bracing members in unison. The connection assembly may comprise an intermediate or central bracket having retaining members suitably at each end thereof which may adjustably retain a movable bolt which carries a support plate for a pair of bracing members attached thereto.

The support plate may also have retaining apertures or sleeves for movable adjustment of individual bracing members.

In a variation of the above, there may be provided a support member, such as a support plate or bracket, for a pair of bracing members, whereby the support member is movable relative to the canopy frame and which also facilitates individual adjustment of bracing members as described above or in the preferred embodiment.

Preferably the abovementioned central bracket is releasably attached to a top end of the upright of each hoop assembly. In this variation the support plate may also be releasably attached to the top end of the upright of each hoop assembly.

In another exemplary embodiment, a method of fabrication or installation of the shelter structure of the invention is provided including the following steps:

supplying each of individual frame members of the canopy frame comprising the pair of lower horizontal rails and the top horizontal rail in components which are adapted to be connected to each other at the installation site before attachment to each of the hoop assemblies and the oblique and/or horizontal bracing members; and (b) elevation of the canopy frame to a desired height by a pair of cranes or other suitable elevation means; and (c) attaching each end of the canopy frame to each end frame.

BRIEF DESCRIPTION OF THE DRAWINGS

Reference may now be made to a preferred embodiment of the shelter structure as shown in the following drawings wherein.

DETAILED DESCRIPTION OF THE DRAWINGS

Figure 1:
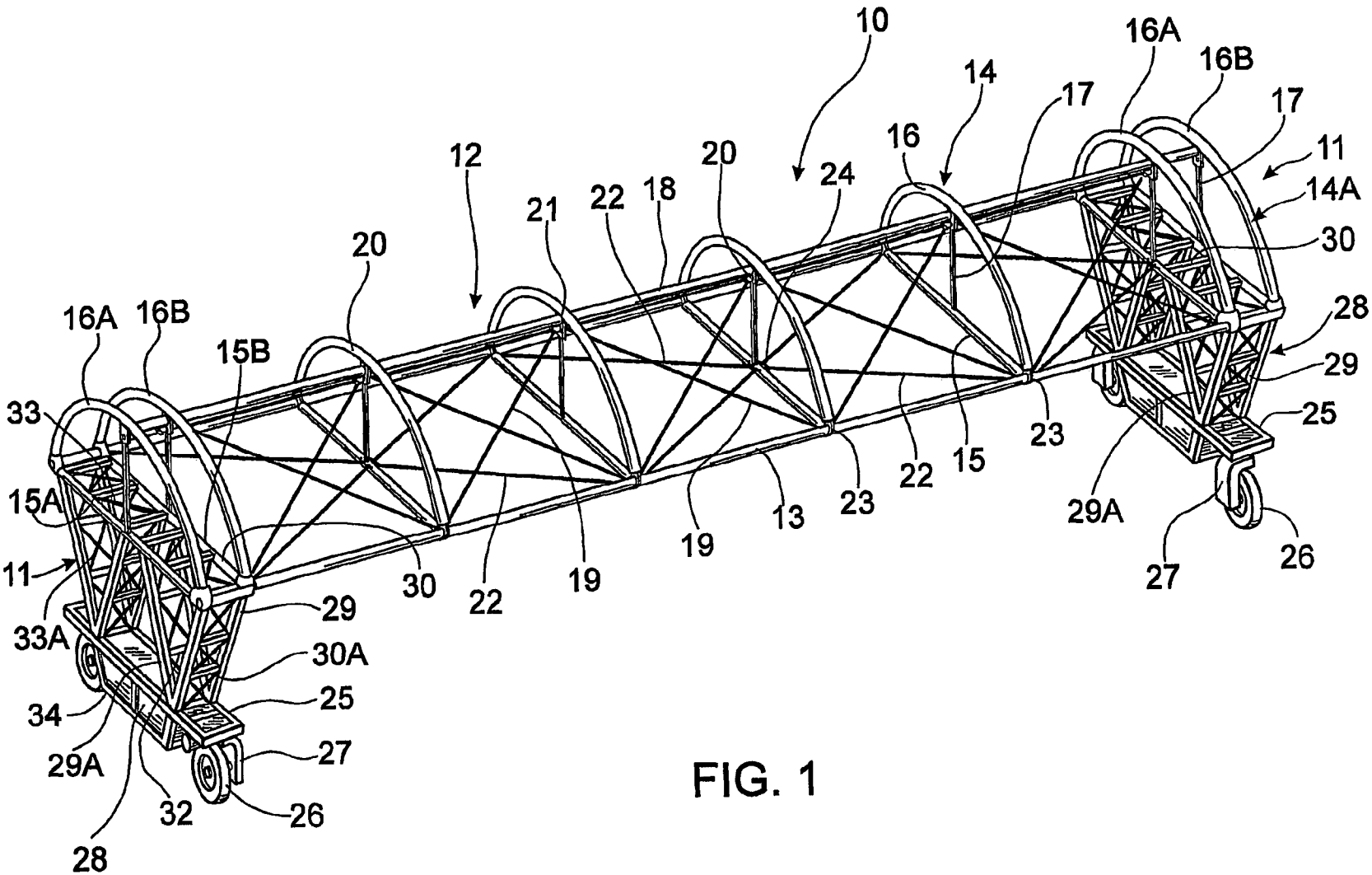
FIG. 1 is a perspective view of a shelter structure of the invention.

In the drawings there is shown mobile shelter structure 10 including end frames 11 and canopy frame 12. Canopy frame 12 comprises horizontal rails 13 and hoop assemblies 14 which each include a transverse rail 15, hoop 16 and post 17. There is also provided a top horizontal rail 18 and diagonally angled or oblique bracing struts 19 which interconnect connection assembly 20 located closely adjacent to and below connection point 21 of hoop 16 and horizontal rail 18 and connections points 23 of hoop 16, horizontal rail 13 and transverse rail 15. There are also provided horizontal bracing struts 22 which interconnect each alternate connection point 23 as shown in FIG. 1. Each bracing strut 22 is located in a horizontal plane as shown and also is attached to connection points 24 between posts 17 and transverse rails 15 as shown in FIG. 1. Each end frame 11 also includes a pair of adjacent end hoops 16A and 16B supported by transverse rails 15A and 15B which are interconnected by cross members 30.

Each end frame 11 comprises a base frame 25 to which wheels 26 are attached by angled wheel supports 27. End frame 11 also includes a pair of frame members 29 located at each end of carriage frame 28 and two pairs of inner frame members 29A.

Each of end frame members 29 are connected by horizontal struts 30A and each of inner frame members 29A are connected by horizontal struts 32. There is also provided horizontal braces 33 as well as diagonal braces 33A.

Figure 2:
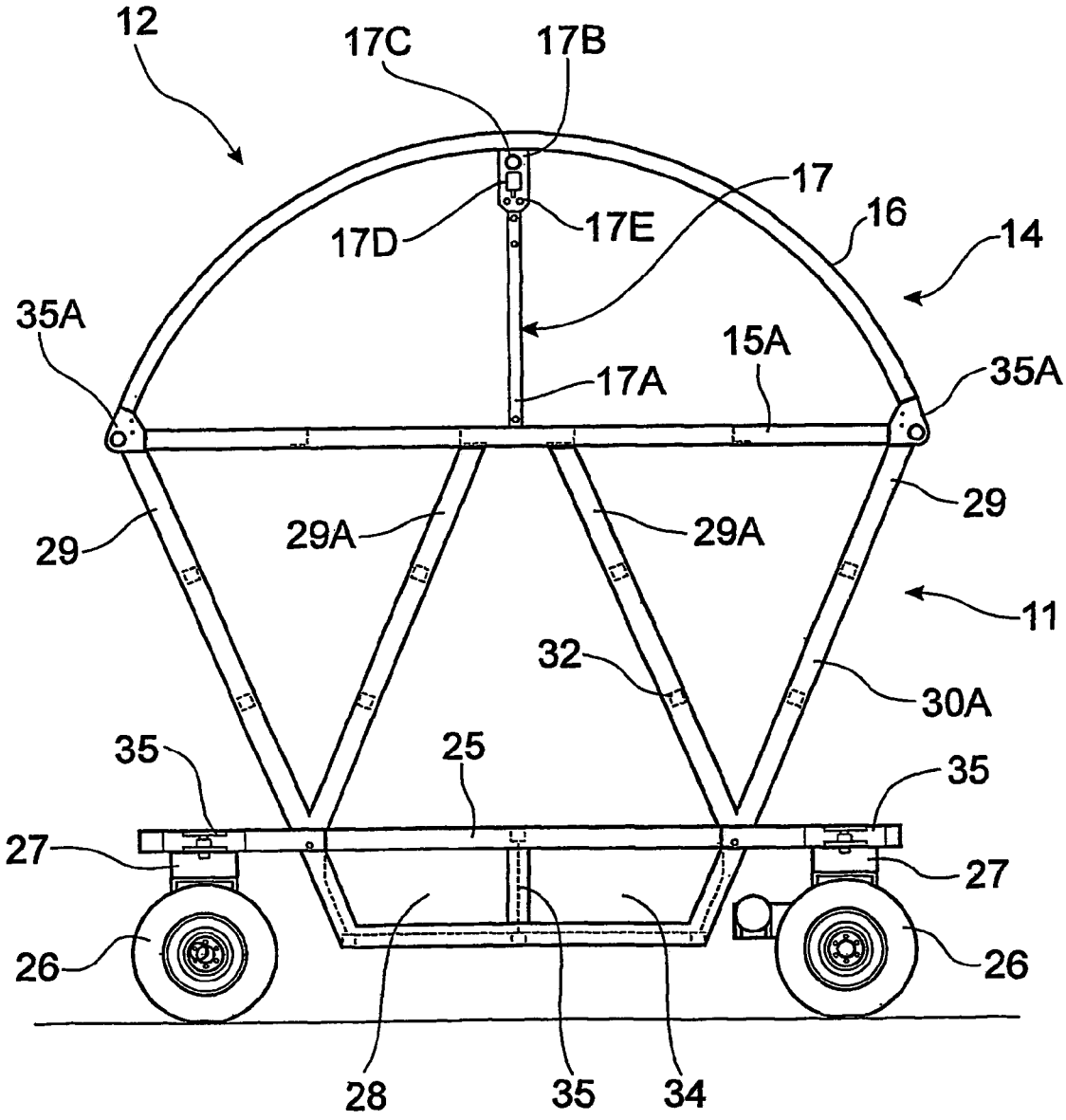
FIG. 2 is an end view of the shelter structure shown in FIG. 1.

As best shown in FIG. 2 there are also provided frame members 34 interconnecting bottom ends of each of frame members 29 and vertical frame member 35 interconnecting frame members 34 to base frame 25. Each of wheel supports 27 are attached to base frame 25 by fastening assemblies 35. There also is provided brackets 35A interconnecting hoops 16A and 16B, rails 15A and 15B and each horizontal rail 13. Posts 17 comprise a body stem 17A and head 17B having aperture 17C, keyhole aperture 17D and attachment apertures 17E. There is also provided ballast tanks 28 as well as drive motor 26A driving one wheel 26 at each end frame 11 with the other wheel 26 being an idler wheel or free-wheeling as shown. Drive motor 26A is supported by support structure 26B.

Figure 3:
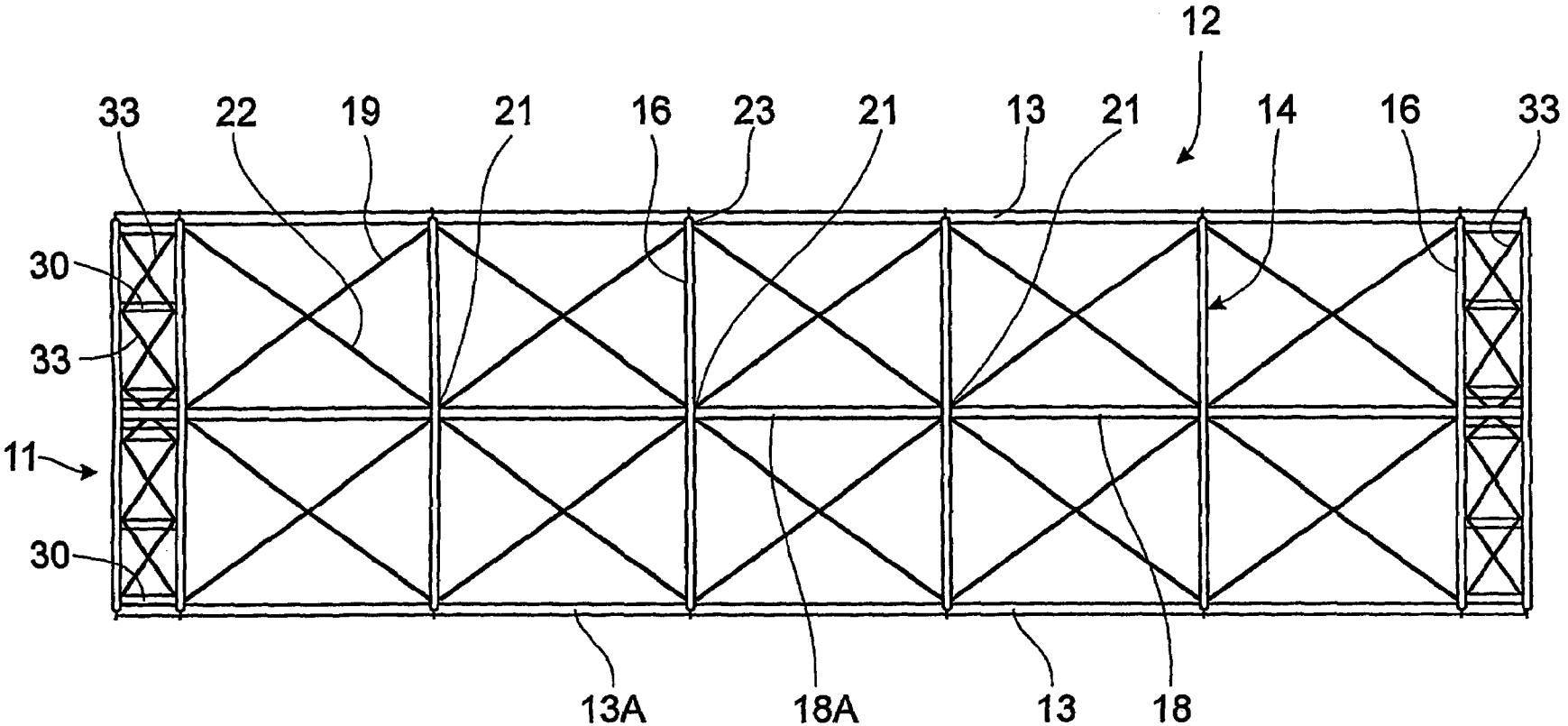
FIG. 3 is a top plan view of the shelter structure shown in FIG. 1.

In FIG. 3 the bracing for shelter structure 10 is shown comprising oblique bracing struts 19 and horizontal bracing struts 22. The diagonal bracing 33 for each end frame 11 is also shown. The provision of both diagonal bracing members 19 and horizontal bracing members 22 is desirable so as to ensure that each of hoop assemblies 14 are properly aligned in the correct orientation relative to horizontal rails 13 and to horizontal rail 18. Thus as shown each hoop assembly 14 should be aligned at right angles to horizontal rails 13 and 18.

Figure 4:
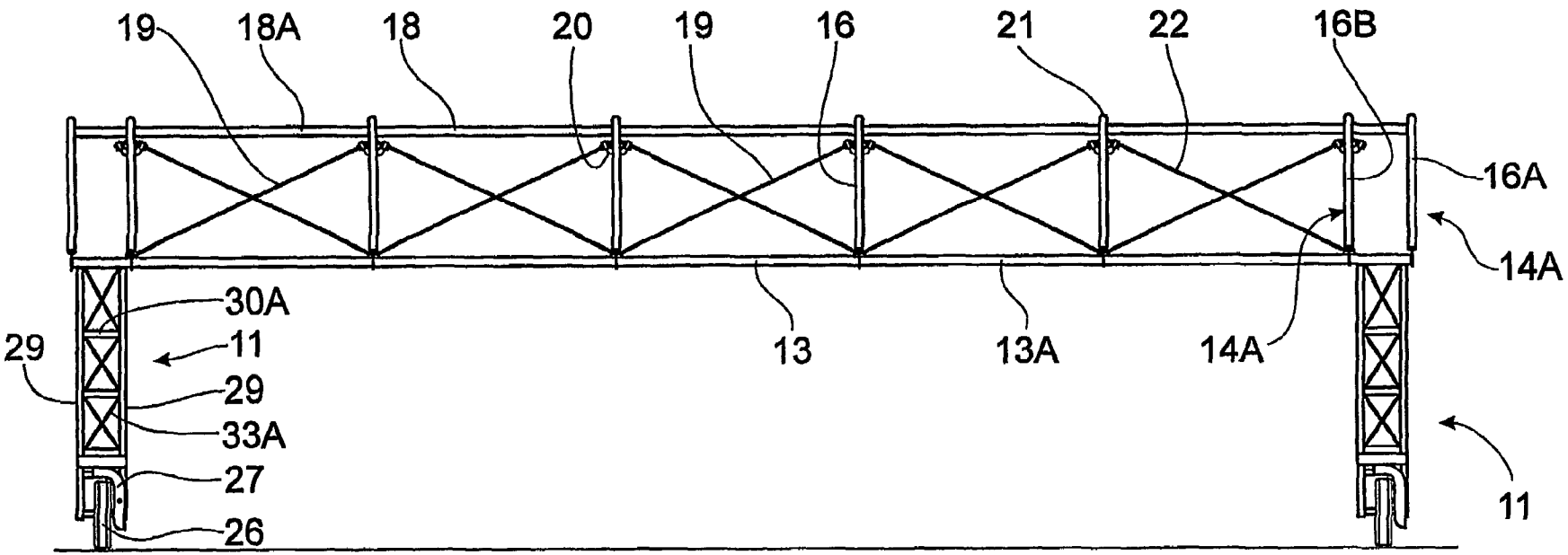
FIG. 4 is a side view of the shelter structure shown in FIG. 1.
Figure 5:
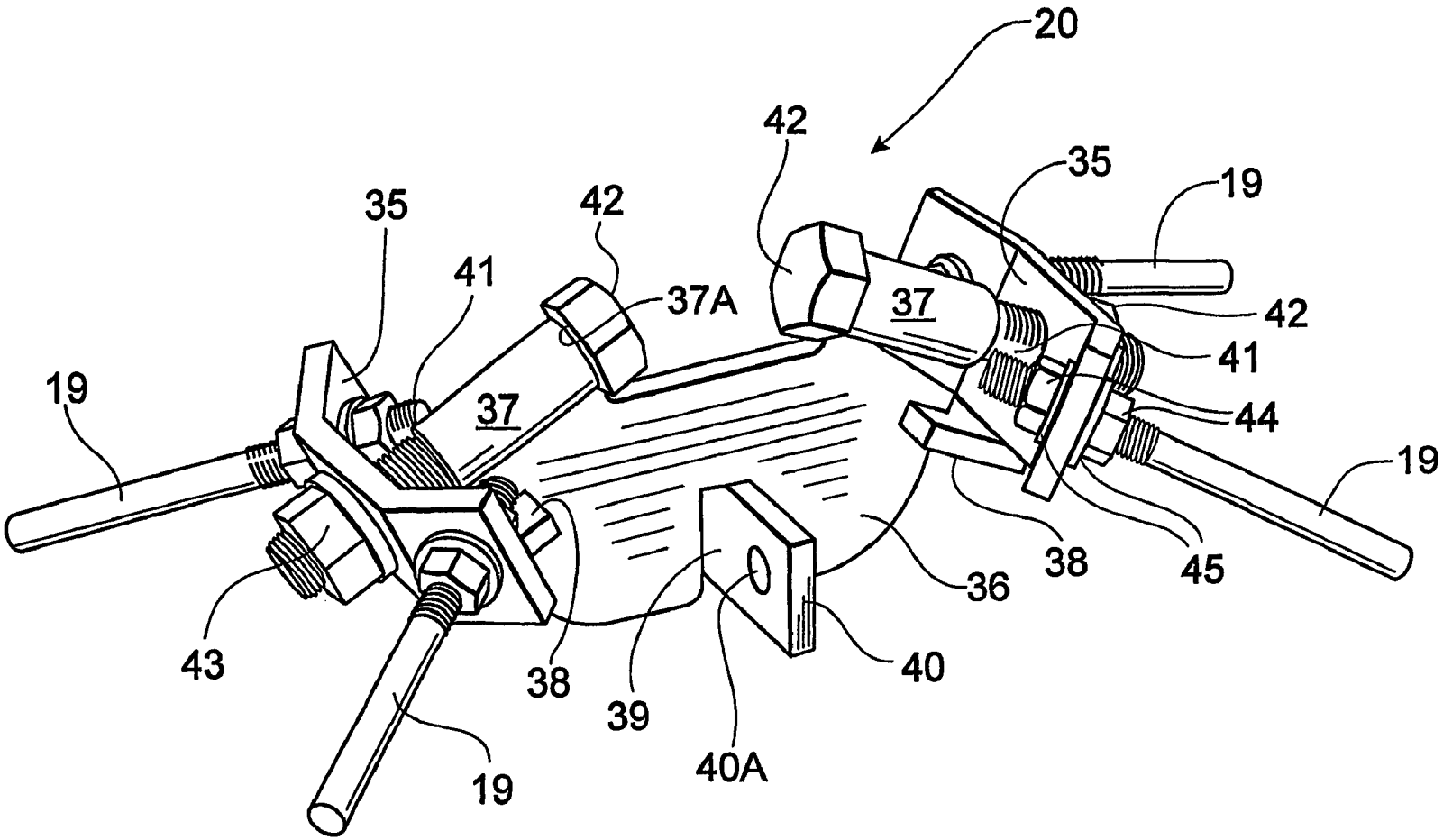
FIG. 5 is a detailed perspective view of the connection assembly between the oblique bracing members and the upright of each hoop assembly.

In FIG. 4 there are also shown connection assemblies 20 illustrated in more detail in FIG. 5 as well as oblique bracing members 19. It will be noted that connection assemblies 20 are located below connection points 21.

In FIG. 5 there is shown connection assembly 20 between each of diagonal bracing members 19 and each post 17 and the mechanism for adjustment in tension of each of the diagonal bracing members 19 is shown whereby connection assembly 20 includes a pair of end plates 35 which are separate from and attached to a central bracket 36. Bracket 36 is provided with a pair of sleeves 37 integral therewith and a pair of end projections 38. Bracket 36 also has a bottom slot 39 which accommodates retaining lug 40 having attachment aperture 40A.

In each sleeve 37 is retained a bolt 41 having a head 42 which bears against an adjacent end of 37A of sleeve 37. The bolt 41 also extends through end plate 35 and is retained in a desired location by adjustment nut 43. Each end plate 35 has a pair of bracing members 19 attached thereto by a pair of nuts 44 and adjacent washers 45 located on each side of end plates 35.

The tension of each bracing member 19 can be adjusted by application of a tension wrench (not shown) to one of nuts 44. This tension may be pre-calibrated or provided with a greater variation or adjustment by movement of each side plate 35 and attached bracing members 19 along bolts 41 by a tension wrench (not shown) engaging adjustment nuts 43. Preferably the tension or torque setting of each bracing member 19 is maintained between 70–90 ft. lbs and more preferably between 78–82 ft. lbs.

Figure 6:
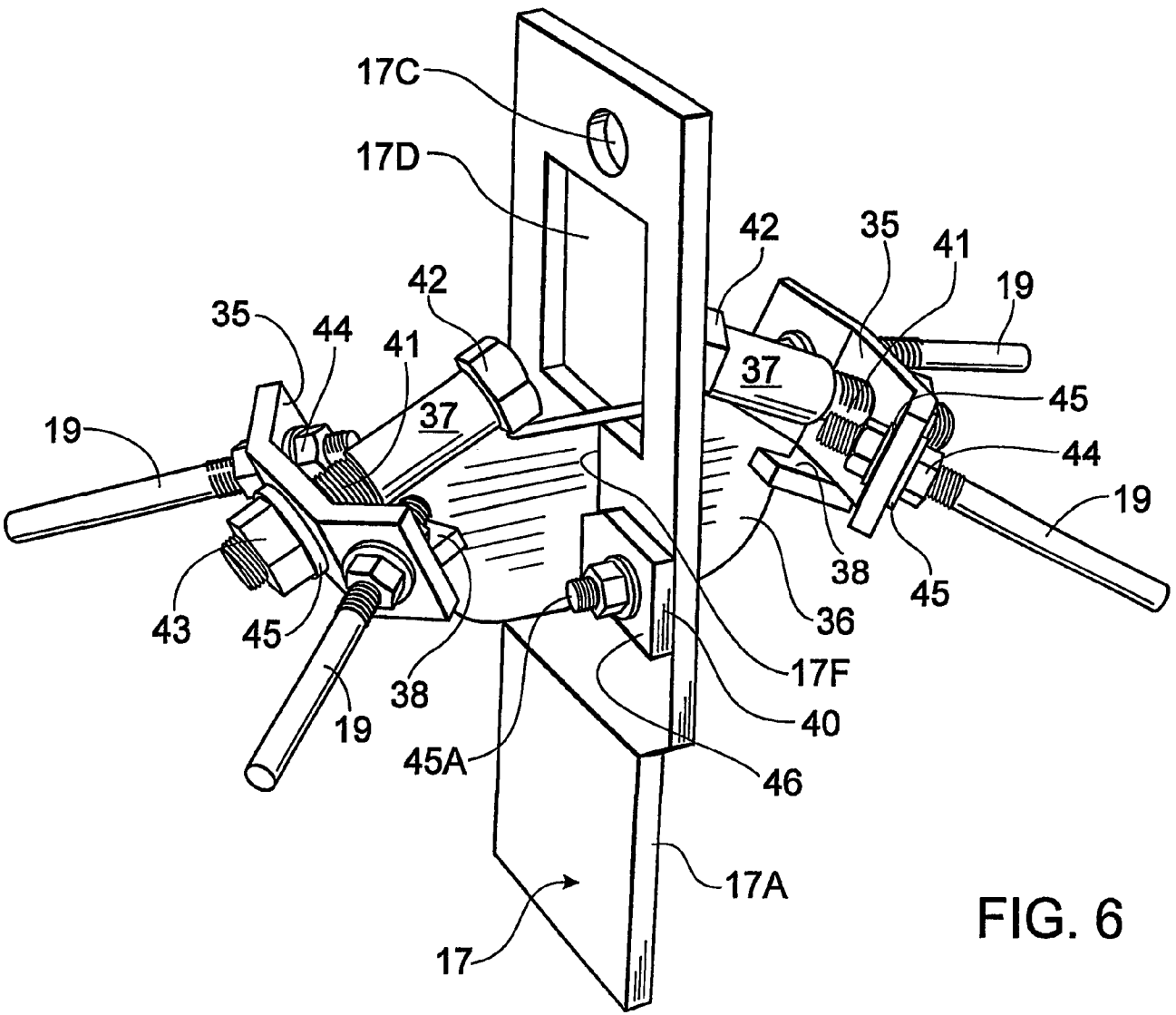
FIG. 6 is a similar view to FIG. 5 showing the attachment of the connection assembly to an adjacent upright of the canopy frame.

In FIG. 6 there is also shown upright 17 and keyhole aperture 17D which has slot 17F for retention of bracket 36 as shown. There is also shown attachment bolts 45A and associated retaining nuts 46 for attachment of upright 17 to retaining lug 40. Bolts 46 extend through apertures 40A.

Assembly of the shelter structure 10 may also occur by construction of canopy frame 10 at the installation site by initially forming each lower rail 13 and top rail 18 by connection of components 13A and 18A, best shown in FIG. 3, to each other suitably by telescopic engagement. Each of components 13A may be connected to each other at connection points 23 and each of components 18A may be connected to each other at connection points 21. Subsequently each of hoop assemblies 14 may be formed by connection of rail 15, hoop 16 and post 17 before attachment of each of hoop assemblies 14 to each of rails 13 and top rail 18.

The assembly so formed may then be elevated to a suitable height so that each end pair of hoop assemblies 14A are mounted to the top of each end frame 11 by use of brackets 35A. Then each of horizontal bracing members 22 may be attached to connection points 23 and 24 and oblique bracing members 19 may be attached between connection points 23 and connection assemblies 20. Alternatively bracing members 19 and 22 may be attached to their respective connection points when the canopy frame 12 is on the ground.

Finally each bracing member 19 is tensioned to its appropriate tension before installation or construction of shelter structure 10 is completed.

It will be appreciated from the foregoing that the shelter structure of the invention is mainly supported by end frames 11 with any loading imparted thereto absorbed by wheels 26 located directly below each base frame 25 as shown. This feature is not described in the prior art discussed above. Each end frame 11 is supplied with ballast tanks 35 and appropriate bracing 33 and 33A. The canopy frame 12 is simple in structure and the provision of adjustable bracing 19 ensures that proper alignment of hoop assemblies 14 with horizontal rails 13 and 18 is provided. Such canopy frame 12 is extremely stable in strong cross winds.

What is claimed is:

1. A shelter structure comprising:

a pair of end frames;

a canopy frame interconnecting the end frames, wherein the canopy frame includes a plurality of adjustable oblique bracing members interconnecting frame members of the canopy frame, wherein said adjustable bracing members may be tensioned during installation of the shelter structure to stabilize the canopy frame when supported by each end frame against lateral or transverse forces; and at least one ground engaging wheel supporting each end frame and located directly below each end frame end driven by drive means, wherein said at least one wheel absorbs any loading imparted to said oblique bracing members during heavy winds.

2. A shelter structure as claimed in claim 1, wherein each of the end frames are supported by a pair of ground engaging wheels with one of said wheels driven by said drive means.

3. A shelter structure as claimed in claim 2, wherein the ground engaging wheels are driven by drive means coupled to each wheel.

4. A shelter structure as claimed in claim 1, wherein each end frame has one or more ballast tanks.

5. A shelter structure as claimed in claim 1, wherein each end frame has a base frame, to which are attached wheel support members, wherein each wheel is located under the base frame so that any loading imparted to each end frame is directly translated to each wheel.

6. A shelter structure as claimed in claim 4, wherein each end frame has a base frame which carries said one or more ballast tanks which are clear of the ground.

7. A shelter structure as claimed in claim 1, wherein each end frame has a plurality of oblique vertical frame members interconnected by cross members.

8. A shelter structure as claimed in claim 1, wherein the canopy frame comprises a pair of spaced and parallel lower horizontal rails and a top horizontal rail.

9. A shelter structure as claimed in claim 8, wherein the canopy frame includes a plurality of hoop assemblies attached to each of the lower rails and the top rail.

10. A shelter structure as claimed in claim 9, wherein each hoop assembly comprises a hoop or arcuate member, a base rail for the hoop and an upright interconnecting an apex of the hoop and a mid point of the base rail.

11. A shelter structure as claimed in claim 8, wherein there are provided horizontal bracing members interconnecting each of the lower rails.

12. A shelter structure as chimed in claim 8, wherein there are provided horizontal bracing members interconnecting diagonally opposite connection points of hoop assemblies with each lower rail.

13. A shelter structure as claimed in claim 9, wherein there are provided oblique bracing members interconnecting diagonally apposite connection points of:

hoop assemblies with each lower rail; and hoop assemblies and the top horizontal rail.

14. A shelter structure as claimed in claim 1, wherein each oblique bracing member is adjustable in tension by individual adjustment of each bracing member.

15. A shelter structure as claimed in claim 1, wherein each oblique bracing member is adjustable in tension by adjustment of adjacent oblique bracing members in unison.

16. A shelter structure as claimed in claim 15, wherein a pair of oblique bracing members is attached to a support member and the support member is movably adjusted relative to a fixed or stationary bracket.

17. A shelter structure as claimed in claim 15, wherein there is provided a connection assembly which interconnects two pairs of oblique bracing members and which facilitates individual adjustment of bracing members as well as adjustment of one pair of bracing members in unison.

18. A shelter structure as claimed in claim 17, wherein the connection assembly comprises a central or intermediate bracket having end plates at each end thereof which each adjustably retain a movable bolt which carries a respective end plate for a pair of bracing members attached thereto.

19. A shelter structure as claimed in claim 18, wherein each end plate has retaining apertures or sleeves for movable adjustment of individual bracing members.

20. A shelter structure as claimed in claim 19, wherein the central bracket is movable relative to he canopy frame.

21. A shelter structure as claimed in claim 18, wherein the central bracket is releasably attached to a top end of the upright of each hoop assembly.

22. A method of fabrication or installation of a shelter structure, the structure including a pair of end frames supported by ground engaging wheels and a canopy frame interconnecting the end frames, wherein the canopy frame includes a plurality of adjustable bracing members interconnecting frame members of the canopy frame, wherein said adjustable bracing members may be tensioned during installation of the shelter structure to stabilize the canopy frame when supported by each end frame against lateral or transverse forces, the method comprises:

supplying frame components of a canopy frame which are connected to each other at an installation site to form frame members of the canopy frame;

attaching said frame members to each other for forming the canopy frame;

attaching each of the adjustable bracing members to the canopy flame;

elevating of the canopy frame to a desired height by a pair of cranes or other suitable elevation means; and attaching each end of the canopy frame to each end frame.

* * * * *